US011501963B2

(12) United States Patent
Yagyu

(10) Patent No.: US 11,501,963 B2
(45) Date of Patent: Nov. 15, 2022

(54) EXCIMER LAMP AND LIGHT IRRADIATION DEVICE

(71) Applicant: Ushio Denki Kabushiki Kaisha, Tokyo (JP)

(72) Inventor: Hideaki Yagyu, Tokyo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/404,046

(22) Filed: Aug. 17, 2021

(65) Prior Publication Data

US 2022/0068626 A1 Mar. 3, 2022

(30) Foreign Application Priority Data

Aug. 28, 2020 (JP) ..... JP2020-144536

(51) Int. Cl.
*H01J 61/16* (2006.01)
*H01J 61/44* (2006.01)

(52) U.S. Cl.
CPC ..... *H01J 61/16* (2013.01); *H01J 61/44* (2013.01)

(58) Field of Classification Search
CPC ..... H01J 61/16; H01J 61/44; H01J 65/046; H01J 61/125
See application file for complete search history.

(56) References Cited

U.S. PATENT DOCUMENTS

| | | | | |
|---|---|---|---|---|
| 5,343,114 | A * | 8/1994 | Beneking | H01J 61/82 313/643 |
| 5,432,398 | A | 7/1995 | Kogelschatz | |
| 5,889,367 | A | 3/1999 | Hofmann et al. | |
| 2015/0035429 | A1* | 2/2015 | Hishinuma | C02F 1/325 313/631 |
| 2016/0205758 | A1* | 7/2016 | Bezel | H01J 65/04 250/503.1 |

FOREIGN PATENT DOCUMENTS

| | | | |
|---|---|---|---|
| CN | 101471226 | A | 7/2009 |
| CN | 103094057 | A | 5/2013 |
| JP | H06-209131 | A | 7/1994 |
| JP | H07-14556 | A | 1/1995 |
| JP | H07-94383 | A | 4/1995 |

(Continued)

OTHER PUBLICATIONS

An Office Action; "Notice of Reasons for Refusal," mailed by the Japanese Patent Office dated Jun. 22, 2021, which corresponds to Japanese Patent Application No. 2020-144536; with English language translation.

(Continued)

*Primary Examiner* — Donald L Raleigh
(74) *Attorney, Agent, or Firm* — Studebaker & Brackett PC

(57) ABSTRACT

An excimer lamp is such that that an interior of a discharge vessel is filled with a first gas including krypton (Kr) or xenon (Xe); a second gas including chlorine (Cl) or bromine (Br); and a third gas which is at least one species selected from among the group consisting of argon (Ar), neon (Ne), and helium (He), and which exhibits a partial pressure $P_b$ that is not less than a partial pressure $P_{lg}$ of the first gas.

4 Claims, 3 Drawing Sheets

(56) References Cited

FOREIGN PATENT DOCUMENTS

| | | | |
|---|---|---|---|
| JP | H08-212982 | A | 8/1996 |
| JP | H10-51081 | A | 2/1998 |
| JP | H10-326597 | A | 12/1998 |
| JP | 2009-163965 | A | 7/2009 |
| JP | 2017-004702 | A | 1/2017 |
| JP | 2018-508936 | A | 3/2018 |
| RU | 2 089 962 | C1 | 9/1997 |
| WO | 2016/112326 | A1 | 7/2016 |

OTHER PUBLICATIONS

International Search Report and Written Opinion of the International Searching Authority; dated Aug. 3, 2021 in PCT/JP2021/020818.

Communication pursuant to Article 94(3) EPC issued by the European Patent Office dated Feb. 7, 2022, which corresponds to European Patent Application No. 21191214.2-1212 and is related to U.S. Appl. No. 17/404,046.

An Office Action mailed by China National Intellectual Property Administration dated Jan. 13, 2022, which corresponds to Chinese Patent Application No. 202110555464.9 and is related to U.S. Appl. No. 17/404,046; with English language translation.

Panchenko A. N. et al., "Ultraviolet KrCI excilamps pumped by a pulsed longitudinal discharge", Technical Physics, vol. 42, No. 1, Jan. 1, 1997, pp. 68-71.

Erofeev M. V. et al., "XeCI-, KrCI-, XeBr- and KrBr-excilamps of the barrier discharge with the nanosecond pulse duration of radiation; Characteristics of radiation from excilamps", Journal of Physics D: Applied Physics, vol. 39, No. 16, Aug. 4, 2006, pp. 3609-3614, Institute of Physics Publishing, GB.

Boichenko A. M. et al., "Simulation of KrCI (222 nm) and XeCI (308 nm) Excimer Lamps with Kr/HCI(CI2) and Xe/HCI(CI2) Binary and Ne/Kr/CI2 Ternary Mixtures Excited by Glow Discharge", Laser Physics, vol. 14, No. 1, Dec. 31, 2003, pp. 1-14, RU.

Ciobotaru L. C. et al., "A comparison between the characteristics of the excimer radiation emitted by Xel2 / XeC12 plasma in a dielectric barrier discharge at moderate pressures", 17th International Conference on Gas Discharges and Their Applications, GD 2008, Sep. 7, 2008, pp. 293-296, IEEE, USA.

The European search report (under R. 61 or R. 63 EPC) or the supplementary european search report issued by the European Patent Office dated Jan. 26, 2022, which corresponds to European Patent Application No. 21191214.2-1212 and is related to U.S. Appl. No. 17/404,046.

Office Action issued in EP 21 191 214.2; mailed by the European Patent Office dated Jul. 27, 2022.

Mikhail I. Lomaev et al., "Excilamps: Efficient Sources of Spontaneous UV and VUV Radiation," Physics-Uspekhi, Feb. 28, 2003, pp. 193-209, vol. 46, No. 2.

* cited by examiner

EXCIMER LAMP AND LIGHT IRRADIATION DEVICE

TECHNICAL FIELD

The present disclosure relates to an excimer lamp and a light irradiation device.

BACKGROUND ART

A light source body (hereinafter referred to as an "excimer lamp") utilizing dielectric barrier discharge in which a voltage is applied by way of quartz glass or another such dielectric body to cause luminescence of luminescent gas(es) with which a luminescent tube is filled is conventionally known.

Excimer lamps radiate short-wavelength light, specific emission wavelength(s) being exhibited thereby depending on the type(s) and combination of luminescent gas(es) employed. For example, excimer lamps utilizing luminescent gas(es) in the form of rare gases such as argon (Ar), krypton (Kr), and xenon (Xe), and excimer lamps utilizing luminescent gases in the form of gas mixtures of the foregoing rare gases with halogen gas(es) such as fluorine (F), chlorine (Cl), iodine (I), and bromine (Br), are known.

PRIOR ART REFERENCES

Patent References

Patent Reference No. 1: JP-A-H7-14556
Patent Reference No. 2: JP-A-2009-163965

SUMMARY OF INVENTION

Problem to be Solved by Invention

In recent years, as demand for light irradiation devices incorporating excimer lamps continues to increase, we have also seen an increased variety of situations in which excimer lamps are used. And in accompaniment thereto, the market is demanding improvement in excimer lamp irradiance. It is an object of the present invention to provide an excimer lamp having improved irradiance, and a light irradiation device provided with the excimer lamp.

Means for Solving Problem

As described in further detail below, as a result of intensive research, the present inventor discovered that causing a third gas which is other than a luminescent gas to be present within the discharge vessel in an amount which is not less than that of a rare gas which makes up the luminescent gases permits improvement in irradiance. The present inventor devised the excimer lamp which is described below based on knowledge gleaned from this discovery.

An excimer lamp in accordance with the present invention is such that an interior of a discharge vessel is filled with a first gas including krypton (Kr) or xenon (Xe);

a second gas including chlorine (Cl) or bromine (Br); and a third gas which is at least one species selected from among the group consisting of argon (Ar), neon (Ne), and helium (He), and a partial pressure $P_b$ of the third gas being not less than a partial pressure $P_{lg}$ of the first gas.

This means that at an excimer lamp in accordance with the present invention the amount of a third gas with which the interior of a discharge vessel is filled is the same as or is greater than the amount of a first gas with which the interior of the discharge vessel is filled. This is based on the attainment of the distinctive knowledge that causing a third gas that does not contribute to luminescence to be present therein in a large amount which is not less than that of a first gas has a beneficial influence on the luminescence of the first gas and a second gas which are luminescent gases. In particular, the knowledge is attained that the discharge phenomenon resulting from luminescent gases including a first gas in the form of krypton (Kr) or xenon (Xe), and a second gas in the form of chlorine (Cl) or bromine (Br) produces a superior effect. As described in further detail below, when a third gas is present therein in a large amount, it is thought that this promotes excitation and/or ionization of luminescent gas(es), as a result of which the amount of excited dimers produced by luminescent gas(es) is increased and irradiance is improved.

Furthermore, it may cause $$P_b/P_{lg} \leq 18.0$$

to be satisfied. From the standpoint of starting characteristics, it may establish an upper limit the range in values for the amount of the third gas which is present therein. In other words, causing the partial pressure $P_b$ of the third gas to be not greater than 18.0 times the partial pressure $P_{lg}$ of the foregoing first gas will prevent deterioration in starting characteristics of the excimer lamp that might otherwise occur in accompaniment to presence of an excessive amount of the third gas, and/or prevent failure of the lamp to light which may accompany deterioration in starting characteristics.

Furthermore, it may cause $$P_b/P_{lg} \leq 10.0$$

to be satisfied. This will make it possible to improve the starting characteristics of the excimer lamp.

It may cause the first gas to consist of krypton (Kr), and the second gas to consist of a gas which includes chlorine. An excimer lamp provided with such a constitution will generate KrCl* and radiate light having a center wavelength of 222 nm.

A light irradiation device in accordance with the present invention is provided with the aforementioned excimer lamp.

Benefit of Invention

This will make it possible to provide an excimer lamp having improved irradiance, and a light irradiation device provided with such an excimer lamp.

EMBODIMENTS FOR CARRYING OUT INVENTION

Light Irradiation Device

Figure 1:
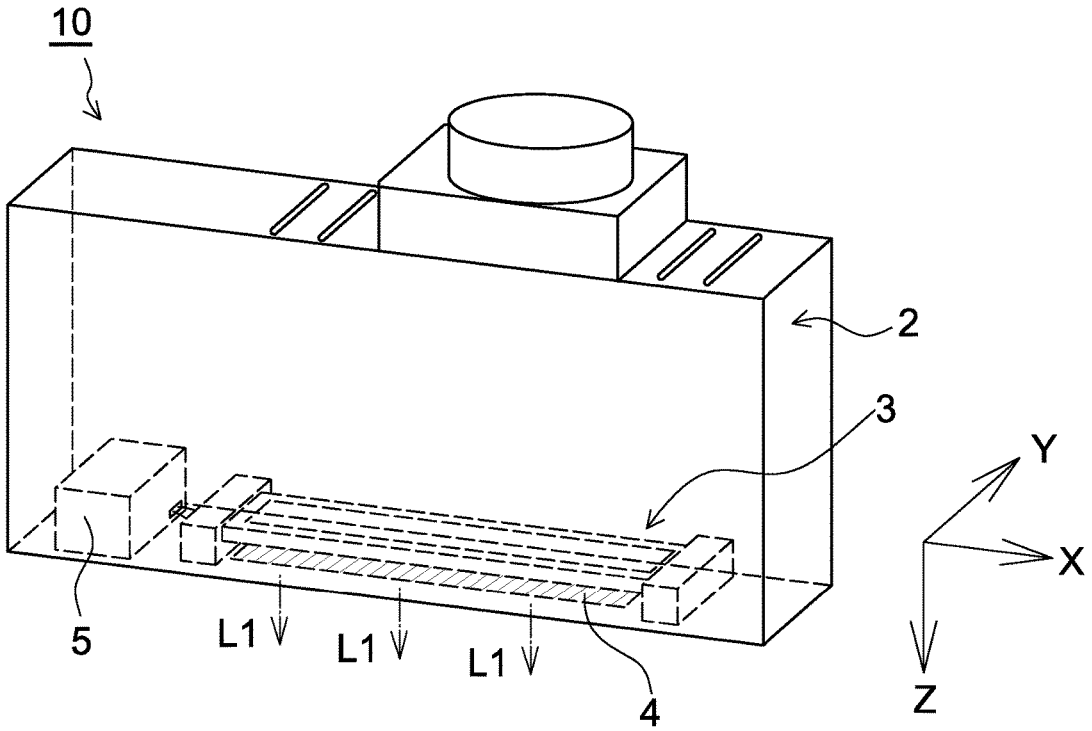
FIG. 1 Perspective view showing in schematic fashion the external appearance of a light irradiation device.

An embodiment of a light irradiation device in accordance with the present invention will be described with reference to FIG. 1. The light irradiation device described below is merely an example, as this may assume a wide variety of forms. Note, moreover, that the respective drawings attached to the present specification are merely schematic representations thereof. That is, dimensional ratios in the drawings and actual dimensional ratios are not necessarily consistent, and dimensional ratios are moreover not necessarily consistent from drawing to drawing.

At the attached drawings, description is given with reference to an X-Y-Z coordinate system in which the Z direction is the direction in which light L1 is extracted, and the XY plane is a plane perpendicular to the Z direction. More specifically, the X direction is the direction of the axis of the tube of an excimer lamp 3. In referring to directions, where a distinction is to be made between positive and negative senses of a direction, this will be indicated by appending a plus or minus sign thereto as in the "+Z direction" and the "−Z direction"; where no distinction is to be made between positive and negative senses of a direction, reference will be made to simply the "Z direction".

FIG. 1 is a perspective view showing in schematic fashion the external appearance of a light irradiation device. As shown in FIG. 1, a light irradiation device 10 is provided with a case 2, at one face of which a light extraction surface 4 (the region indicated by hatching in the form of diagonal lines at FIG. 1) is formed. The excimer lamp 3 is arranged alongside to the light extraction surface 4 within the interior space that is enclosed by the case 2. Within the case 2, a reflector (not shown) that reflects light radiated from the excimer lamp 3 is disposed at a location (in the −Z direction from the excimer lamp 3 at FIG. 1) which faces the light extraction surface 4 in such fashion as to straddle the excimer lamp 3 therebetween. Electricity is supplied to the excimer lamp 3 from an power supply 5.

Excimer Lamp

Figure 2A:
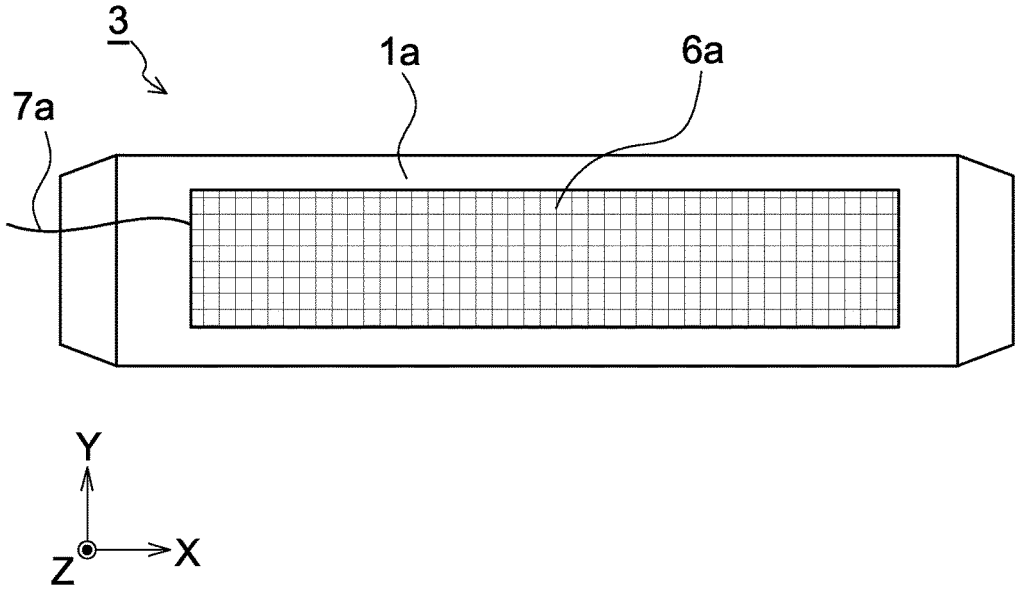
FIG. 2A Drawing of an excimer lamp as seen when looking in the −Z direction from a location at the +Z side thereof.
Figure 2B:
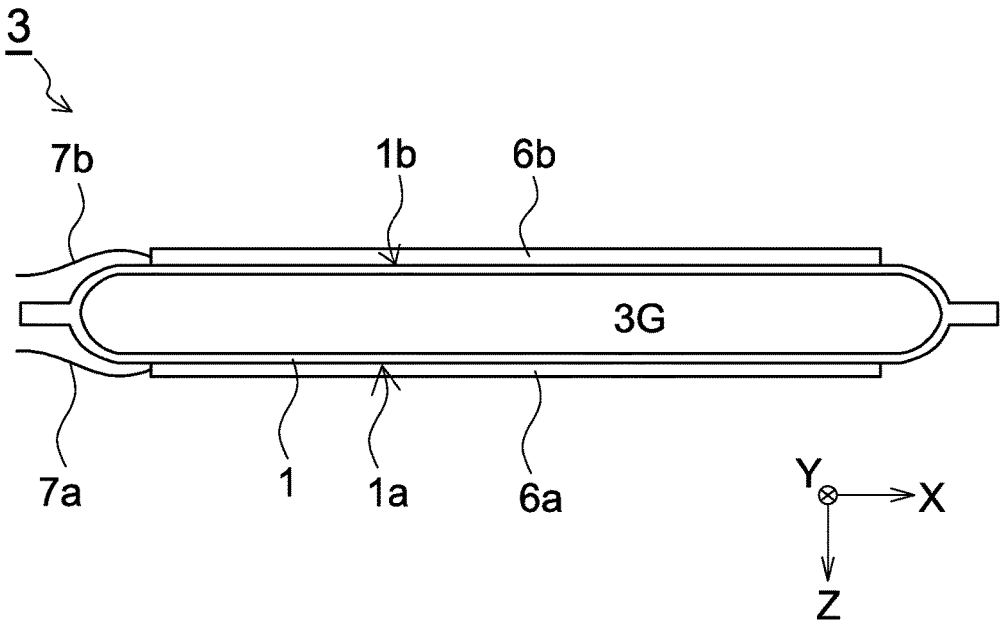
FIG. 2B Drawing of an excimer lamp as seen when looking in the +Y direction from a location at the −Y side thereof.

FIG. 2A is a drawing of the excimer lamp 3 as seen when looking in the −Z direction from a location at the +Z side thereof; FIG. 2B is a drawing of the excimer lamp 3 as seen when looking in the +Y direction from a location at the −Y side thereof. As shown in FIG. 2B, the excimer lamp 3 is an elongated discharge vessel 1, the interior of which is filled with gas 3G, described below. The discharge vessel 1 consists of a hollow flattened tube which is sealed at either end in the X direction, and preferably consists of a glass tube (e.g., quartz glass). The excimer lamp which is described here, like the aforementioned light irradiation device, is merely an example, as this may assume a wide variety of forms.

The excimer lamp 3 is such that provided at the outer surface (1*a*, 1*b*) of the discharge vessel 1 are a pair of electrodes (6*a*, 6*b*) which are disposed in mutually opposed fashion so as to straddle the discharge vessel 1. Electric power is supplied to the pair of electrodes (6*a*, 6*b*) by way of respective electricity supply cables (7*a*, 7*b*). A voltage lower than that at the electrode 6*b* may be applied to the electrode 6*a*, and the electrode 6*a* may be electrically connected to ground or earth.

When electric power is supplied by way of electricity supply cables (7*a*, 7*b*) from the power supply 5 to the electrodes (6*a*, 6*b*), a plasma is generated as a result of dielectric barrier discharge between the two electrodes (6*a*, 6*b*) which straddle the discharge vessel 1. The plasma is such that excitation of atoms making up gas 3G causes these to attain excimer state(s), excimer luminescence occurring when these atoms transition to their ground state(s). This excimer luminescence is light which exhibits specific emission wavelength(s).

As shown in FIG. 2A, the electrodes (6*a*, 6*b*) are each mesh-like. The light that is generated will therefore pass through the interstices of mesh-like electrode 6*a* and be radiated in the +Z direction from the discharge vessel 1. As the aforementioned reflector is present at the side thereof toward the electrode 6*b*, light is reflected from the reflector and is radiated in the +Z direction from the discharge vessel 1. Light radiated in the +Z direction is extracted as light L1 from the light extraction surface 4 (see FIG. 1).

Excimer Luminescence

Detailed description will be given with respect to the mechanism of excimer luminescence. Excimer generally refers to a polyatomic molecule which is in an excited state (a high-energy metastable state), excited dimers being among the known examples of such polyatomic molecules. An excited dimer is created in a plasma produced by dielectric barrier discharge when one of two atoms constituting a pair of atoms becomes excited or ionized and joins with the other atom to form a comparatively stable bonding potential (metastable state).

Known excited dimers include, for example, $Xe_2$* (xenon excimer; * here indicating an excited state), $Kr_2$* (krypton excimer), $Ar_2$* (argon excimer), and other such rare gas dimers, KrF* (krypton fluoride exciplex), ArF* (argon fluoride exciplex), KrCr (krypton chloride exciplex), XeCr (xenon chloride exciplex), and other such rare gas halide exciplexes.

Because such excited dimers are extremely unstable compounds, they quickly return to low-energy states, become dissociated, and ultimately go back to being atoms in stable states (ground states). The energy (E) which is released at such time is radiated as light (excimer light; v=E/h) of characteristic frequency (u) (h=Planck's constant).

When the excited dimer is to be a rare gas halide exciplex, the discharge vessel is filled with luminescent gases in the form of a first gas which is a rare gas, and a second gas which is a halogen gas.

In the embodiment, the first gas includes of krypton (Kr) or xenon (Xe), and the second gas includes chlorine (Cl) or bromine (Br). The excimer lamp of the embodiment therefore causes formation of KrCr (primary peak wavelength=222 nm), KrBr* (primary peak wavelength=207 nm), XeCr (primary peak wavelength=308 nm), or XeBr* (primary peak wavelength=282 nm), and radiates ultraviolet light having peak(s) of specific emission wavelength(s).

To improve the irradiance of an excimer lamp in accordance with the present invention, it will be effective to increase the number of excited dimers, i.e., the number of rare gas halide exciplexes, within the discharge space. The present inventor initially thought that to increase the number of excited dimers one should increase the amount of the luminescent gases (the first gas and the second gas) from which the excited dimers are constituted; i.e., that one should increase the gas pressures of the luminescent gases.

However, when the gas pressures of the luminescent gases were increased it was found that this tended to cause poor starting characteristics. Starting characteristics refer to the lag in time from when starting operations were initiated (initiation of application of voltage to electrodes) until light of given irradiance is radiated therefrom. When this lag in time is small, starting characteristics are said to be good;

when this lag in time is large, starting characteristics are said to be bad. Furthermore, if the gas pressures of the luminescent gases are increased still further, it is sometimes the case that the lamp never lights despite the fact that starting operations were initiated. This is thought to be due to Paschen's law.

Buffer Gas

With the foregoing situation in mind, as a result of further intensive and repeated research, the present inventor arrived at the idea of filling the discharge vessel with a large amount of a third gas which is not a luminescent gas. A third gas refers to a buffer gas that tends not to form excited dimers within the discharge space. As such a buffer gas, a rare gas for which the size of the atoms and the atomic mass are smaller and lighter than is the case with the rare gas (first gas) that makes up the luminescent gas(es) is employed.

More specifically, the third gas is any one gas or gas mixture of at least one species selected from among the group consisting of argon (Ar), neon (Ne), and helium (He). A third gas like a first gas is a rare gas, but is one for which, due to a difference in atomic mass, the luminescent effect exhibited by the third gas is small or is substantially non-existent.

While the principle behind the effect that is exhibited as a result of employment of a large amount of a third gas is not completely clear, it is thought that the following may explain this effect. It may be that employment of a buffer gas causes there to be an increase in the overall gas pressure within the discharge vessel without causing a change in the ratio of partial pressures of the first gas and the second gas which constitute the luminescent gases. And it may be that the third gas has a higher excitation energy than the first gas, such that it has the characteristic of remaining in a metastable state for a long time as a result of excitation. Where this is the case, it is thought that employment of a third gas that causes there to be an increase in overall gas pressure within the discharge vessel may result in a situation in which luminescent gas(es) collide with atoms making up the excited third gas and promote excitation and/or ionization of luminescent gas(es), as a result of which the number of excited dimers produced by luminescent gas(es) is increased and irradiance is improved.

In other words, it may be that employment of a third gas provides increased opportunities for excited and/or ionized atoms to join with other atoms and increases the number of excited dimers. Increase in the number of excited dimers would be expected to cause improvement in irradiance. It is further thought that a higher efficiency of formation of excited dimers by the third gas than by luminescent gas(es) during the initial stages of application of voltage to the electrodes as well would explain why employment of a third gas at the excimer lamp would cause starting characteristics to be better than would be the case were a third gas not employed at the excimer lamp.

Irradiance

Figure 3:
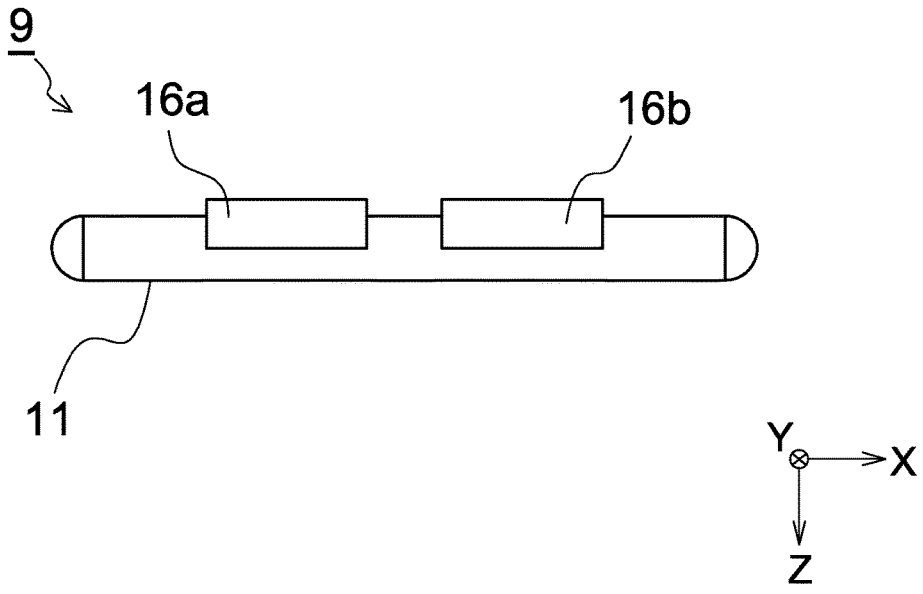
FIG. 3 Schematic diagram of an excimer lamp used for measurement of irradiance.

The preferred partial pressure of the buffer gas, i.e., preferred amount of buffer gas employed, will differ depending on the partial pressure(s) of the luminescent gas(es) (especially the first gas). As shown in FIG. 3, a plurality of excimer lamps 9 were prepared, each of which had a hollow cylindrical tube 11, the interior of which was capable of being filled with luminescent gases, the excimer lamps (Sample Nos. 1 through 9) that were prepared being such that each specimen was filled with a third gas at a different third gas partial pressure $P_b$ to achieve a characteristic partial pressure ratio ($P_b/P_{lg}$). In addition, the excimer lamps having the respective Sample Nos. were lit, and the irradiance of the respective specimens were measured. TABLE 1 shows the results of measurement of the irradiance of the respective samples (excimer lamps) which had characteristic third gas partial pressures and partial pressure ratios relative to those of the first gas.

Description will be given with respect to the electrodes of the excimer lamp 9 shown in FIG. 3. Two electrode blocks (16*a*, 16*b*) are arranged so as to come in contact with the outer surface of the cylindrical tube 11. The two electrode blocks (16*a*, 16*b*) are electrically connected to the electricity supply cables (not shown) and constitute electrodes for supply of electricity to the excimer lamp 9. When a voltage is applied to these two electrodes, this causes occurrence of dielectric barrier discharge and radiation of excimer light.

An irradiance sensor (VUV-S172 manufactured by Ushio Inc.) was attached at a location 68 mm from the outer surface of the cylindrical tube 11 of the excimer lamp 9, and an irradiance meter (UIT-250 manufactured by Ushio Inc.) was used to measure the light radiated from the excimer lamp 9 and obtain the irradiance thereof.

At all of the excimer lamp samples, partial pressure $P_{lg}$ of the first gas was made to be 8.0 kPa, and partial pressure of the second gas was made to be 0.067 kPa. In addition, all of the excimer lamp samples were filled with krypton (Kr) as the first gas, chlorine gas ($Cl_2$) as the second gas, and neon (Ne) as the third gas.

TABLE 1

| Sample No. | Partial Pressure of Third Gas $P_b$ (kPa) | Partial Pressure Ratio of Third Gas to First Gas ($P_b/P_{lg}$) | Irradiance (mW/cm$^2$) |
|---|---|---|---|
| 1 | 2.7 | 0.33 | 2.57 |
| 2 | 5.3 | 0.67 | 3.76 |
| 3 | 8.0 | 1.00 | 4.30 |
| 4 | 16.0 | 2.00 | 4.66 |
| 5 | 21.3 | 2.67 | 4.59 |
| 6 | 26.7 | 3.33 | 4.55 |
| 7 | 32.0 | 4.00 | 4.59 |
| 8 | 36.0 | 4.50 | 4.59 |
| 9 | 42.7 | 5.33 | 4.45 |

Figure 4:
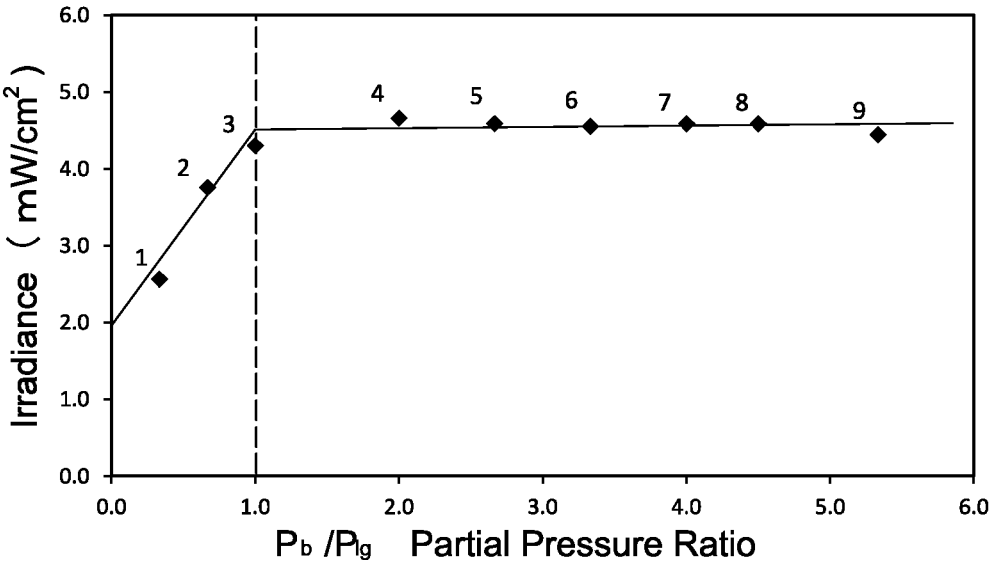
FIG. 4 Scatter plot of points showing relationship between irradiance and the partial pressure ratio of the partial pressure of a third gas to the partial pressure of a first gas.

FIG. 4 is a scatter plot of points showing the relationship between irradiance (units=mW/cm$^2$) and partial pressure ratio ($P_b/P_{lg}$) for the respective samples at TABLE 1. At this scatter plot, best-fit lines have been drawn based on the points plotted therein. The numbers in the vicinities of the points plotted on this scatter plot indicate the corresponding Sample Nos. at TABLE 1. It is clear that irradiance improves with increasing partial pressure ratio ($P_b/P_{lg}$) at Sample Nos. 1 through 3. It is clear that there is little improvement in irradiance despite increase in partial pressure ratio ($P_b/P_{lg}$) at Sample Nos. 4 through 9.

Based on FIG. 4, the partial pressure ratio ($P_b/P_{lg}$) of the partial pressure $P_b$ of the third gas to the partial pressure $P_{lg}$ of the first gas should be chosen so as to satisfy Formula (1):

$$1.0 \leq P_b/P_{lg} \quad (1)$$

Stating this another way, the partial pressure $P_b$ of the third gas should be chosen so as to be not less than the partial pressure $P_{lg}$ of the first gas.

In other words, the third gas should be present therein in an amount which is not less than that of the rare gas which makes up the luminescent gases. Where this was done, it was possible to maintain an irradiance level that was not less than 4.0 mW/cm$^2$. Stating this another way, it is fair to say that by doing this it was possible to form an ideal state in which formation of excited dimers of luminescent gases (the rare gas and the halogen) with which the interior of the discharge vessel was filled was facilitated. Here, it is fair to say that the partial pressure $P_b$ of the third gas which is not less than the partial pressure $P_{lg}$ of the first gas (i.e., the value of $P_b$ when the partial pressure ratio $P_b/P_{lg}$ is 1.0) is a value that is of critical significance in that it permits attainment of an irradiance close to the maximum irradiance achievable when the partial pressure ratio is varied.

Furthermore, as an ancillary effect of improving irradiance, it was found that life (period of time for which luminescence at specified irradiance or higher was possible) of the light source was also improved. While this effect will vary depending on the luminescent gas component(s), there was, for example, an excimer lamp contained a third gas, for which it was confirmed that life had improved by on the order of 2 to 3 times that of an excimer lamp that did not contain a third gas. It is speculated that this may have been due to the fact that presence of a large amount of a third gas prevents consumption of chlorine. It is thought that this may be due to the fact that increasing the amount of the third gas which is present therein increases the probability that excited chlorine will collide with the third gas and decreases the probability that the excited chlorine will impinge upon the discharge vessel. Such a tendency would tend to cause excimer lamp life to improve in accompaniment to increase in the amount of the third gas which is employed.

Starting Characteristics

While the third gas tends to permit maintenance of starting characteristics more satisfactorily than is the case with the first gas which is a luminescent gas, there is a limit to the amount of the third gas that can be employed. Excimer lamps (Sample Nos. 11 through 23) were prepared such the partial pressure $P_b$ of the third gas was varied such that each sample had a characteristic partial pressure ratio ($P_b/P_{lg}$), these were lit, and the starting characteristics of the respective samples were measured, the results of which are shown in TABLE 2. At the starting characteristics shown in TABLE 2, "A" indicates a starting time delay that was not greater than 5 seconds, "B" indicates a starting time delay that was greater than 5 seconds but not greater than 10 seconds, and "C" indicates a starting time delay that was greater than 10 seconds.

At all of the excimer lamp samples, partial pressure $P_{lg}$ of the first gas was made to be 8.0 kPa, and partial pressure of the second gas was made to be 0.067 kPa. In addition, all of the excimer lamp samples were filled with krypton (Kr) as the first gas, chlorine gas ($Cl_2$) as the second gas, and neon (Ne) as the third gas. In carrying out testing for measurement of starting characteristics, note that no supplemental starting light source or other such device for elimination of the starting delay was used.

TABLE 2

| Sample No. | Partial Pressure of Third Gas $P_b$ (kPa) | Partial Pressure Ratio of Third Gas to First Gas ($P_b$/Fig) | Starting Characteristics |
|---|---|---|---|
| 11 | 2.7 | 0.33 | A |
| 12 | 5.3 | 0.67 | A |
| 13 | 8.0 | 1.00 | A |
| 14 | 16.0 | 2.00 | A |
| 15 | 21.3 | 2.67 | A |
| 16 | 26.7 | 3.33 | A |
| 17 | 32.0 | 4.00 | A |
| 18 | 36.0 | 4.50 | A |
| 19 | 42.7 | 5.33 | A |
| 20 | 80.0 | 10.0 | A |
| 21 | 96.0 | 12.0 | B |

TABLE 2-continued

| Sample No. | Partial Pressure of Third Gas $P_b$ (kPa) | Partial Pressure Ratio of Third Gas to First Gas ($P_b$/Fig) | Starting Characteristics |
|---|---|---|---|
| 22 | 144.0 | 18.0 | B |
| 23 | 160.0 | 20.0 | C |

From TABLE 2, the light irradiation device starting characteristics which are A or B are preferred. That is, $$P_b/P_{lg} \leq 18.0 \quad (2)$$

should be satisfied. Causing Formula (2) to be satisfied will make it possible to prevent deterioration in starting characteristics, and/or prevent failure of the lamp to light which may accompany deterioration in starting characteristics, of the excimer lamp.

When $P_b/P_{lg}$ is greater than 18.0, it is thought that the partial pressure $P_{lg}$ of the first gas is insufficient relative to the partial pressure $P_b$ of the third gas and that the energy for excitation and/or ionization of the first gas is lost to the buffer gas (third gas) to an excessive degree, causing deterioration in starting characteristics.

Causing the light irradiation device starting characteristics to be A is even more preferred. That is, $$P_b/P_{lg} \leq 10.0 \quad (3)$$

should be satisfied. Causing Formula (3) to be satisfied will make it possible to improve starting characteristics.

Note that even where starting characteristics are C or B, there are situations in which it is possible to make the excimer lamp capable of being used or to improve the starting characteristics thereof by increasing the voltage that is applied to the electrodes, employing a supplemental starting light source or other such device for elimination of the starting delay, and so forth.

Because the aforementioned excimer lamp 3 employs luminescent gas(es) in the form of a first gas including krypton (Kr) and a second gas including chlorine gas ($Cl_2$), it generates KrCr and radiates light having a center wavelength of 222 nm. Light of this wavelength is harmless to humans but has properties such as the fact that it possesses germicidal action.

It may employ xenon gas (Xe gas) instead of krypton gas (Kr gas) at the first gas. It may use bromine gas ($Br_2$ gas) or hydrogen chloride gas (HCl gas) at the second gas. Even where the type(s) of gas(es) making up first gas and/or the second gas are different from those described above, trends similar to those described above will nonetheless be exhibited thereby.

It may employ any of argon (Ar), neon (Ne), and/or helium (He) at the third gas. Regardless of which gas is used, the size of the atoms and the atomic mass thereof should be smaller and lighter than the size of the atoms and the atomic mass at the first gas which is a rare gas that makes up the luminescent gas(es).

Where argon (Ar) is used as the third gas, because the size of the atoms thereof is larger than would be the case with neon (Ne) or helium (He), there is a tendency for the probability of collisions with excited chlorine to increase. For this reason, where argon (Ar) is used as the third gas, this will tend to make it easier to improve longevity-related properties.

Where neon (Ne) is used as the third gas, there will be an increased tendency for the Penning effect to be exhibited than would be the case were argon (Ar) or helium (He) employed. This is because the metastable excitation energy of neon (Ne) is greater than the ionization energy of krypton (Kr) or xenon (Xe), and is closer to that of krypton (Kr) or xenon (Xe) than that of argon (Ar) or helium (He).

Where helium (He) is used as the third gas, there is less tendency for there to be interference with the excited state of the halogen and the rare gas that make up the luminescent gas(es) than would be the case with argon (Ar) or neon (Ne). This is because the excitation energy of helium (He) is greater than that of argon (Ar) or neon (Ne).

As described above, the third gas(es) employed should be chosen in accordance with the circumstances. Furthermore, pursuant to the foregoing, the third gas may be a gas mixture in which a plurality of gases are mixed.

While examples of embodiments of an excimer lamp and a light irradiation device have been described above, the present invention is not to be limited in any way by the foregoing embodiments, a great many variations and/or improvements on the foregoing embodiments being possible without departing from the gist of the present invention.

For example, it may employ excimer lamps of shapes and/or sizes other than those described above, and it may employ a light irradiation device for which the structure of the lamp housing and/or the electrodes is different from that at the light irradiation device 10 described above. Furthermore, there would be no objection to inclusion of gas(es) other than the aforementioned first gas, second gas, and third gas at the excimer lamp to the extent that doing so would not greatly interfere with excimer luminescence.

The invention claimed is:

1. An excimer lamp, comprising a discharge vessel; and a pair of electrodes arranged on an outer surface of the discharge vessel, wherein an interior of the discharge vessel is filled with a first gas comprising krypton (Kr);

a second gas comprising chlorine (Cl) or bromine (Br); and a third gas which is at least one species selected from among the group consisting of argon (Ar), neon (Ne), and helium (He), a partial pressure Pb of the third gas being not less than a partial pressure $P_{lg}$ of the first gas, wherein the excimer lamp satisfies Pb/Plg 10.0, wherein where the second gas includes chlorine (Cl), an ultraviolet light having a primary peak wavelength of 222 nm radiates by the excited dimers of KrCl*, and wherein where the second gas includes bromine (Br), an ultraviolet light having a primary peak wavelength of 207 nm radiates by the excited dimers of KrBr*.

2. The excimer lamp according to claim 1, wherein the second gas consists of a gas which includes chlorine.

3. A light irradiation device which is provided with the excimer lamp according to claim 1.

4. A light irradiation device which is provided with the excimer lamp according to claim 2.

* * * * *